US005411417A

United States Patent [19]

Horn et al.

[11] Patent Number: 5,411,417

[45] Date of Patent: May 2, 1995

[54] TERMINAL BLOCK ARRANGEMENT WITH OVERVOLTAGE PROTECTION COMPONENT

[75] Inventors: Dietmar Horn; Klaus Strate, both of Detmold, Germany

[73] Assignee: Weidmueller Interface GmbH & Co., Detmold, Germany

[21] Appl. No.: 281,618

[22] Filed: Jul. 28, 1994

[30] Foreign Application Priority Data

Jul. 30, 1993 [DE] Germany ..... 43 25 614.7

[51] Int. Cl.[6] ..... H01R 9/22

[52] U.S. Cl. ..... 439/709; 439/922

[58] Field of Search ..... 439/709–712, 439/715, 716, 719, 723, 724, 725–729, 922; 361/119

[56] References Cited

U.S. PATENT DOCUMENTS 3,670,207 6/1972 Seabury, III ..... 439/922 X
4,159,500 6/1979 Baumbach et al. ..... 439/922 X
4,741,711 5/1988 Singer, Jr. ..... 439/922 X
5,224,881 7/1993 LeJuste et al. ..... 439/709

OTHER PUBLICATIONS

Fuji Electric Ind. Co., Ltd. Fuji Control Parts Cat. No. N88029 Connection Device 1988.

*Primary Examiner*—Khiem Nguyen
*Attorney, Agent, or Firm*—Laubscher & Laubscher

[57] ABSTRACT

An insulated terminal block body having a pair of electrical terminals (12, 12') connected by a conductive terminal bus bar (4) is provided with a removably connected overvoltage component (2) having a pair of parallel spaced conductive leads (8, 8') maintained by a pair of resilient members (6, 6') in frictional electrical contact with a portion of the bus bar and with a ground conductor, respectively. In a first embodiment, the ground conductor is a ground bar (5), and in second and third embodiments, the ground conduction comprises the support rail (3) upon which the terminal block body is mounted.

13 Claims, 2 Drawing Sheets

FIG. 1
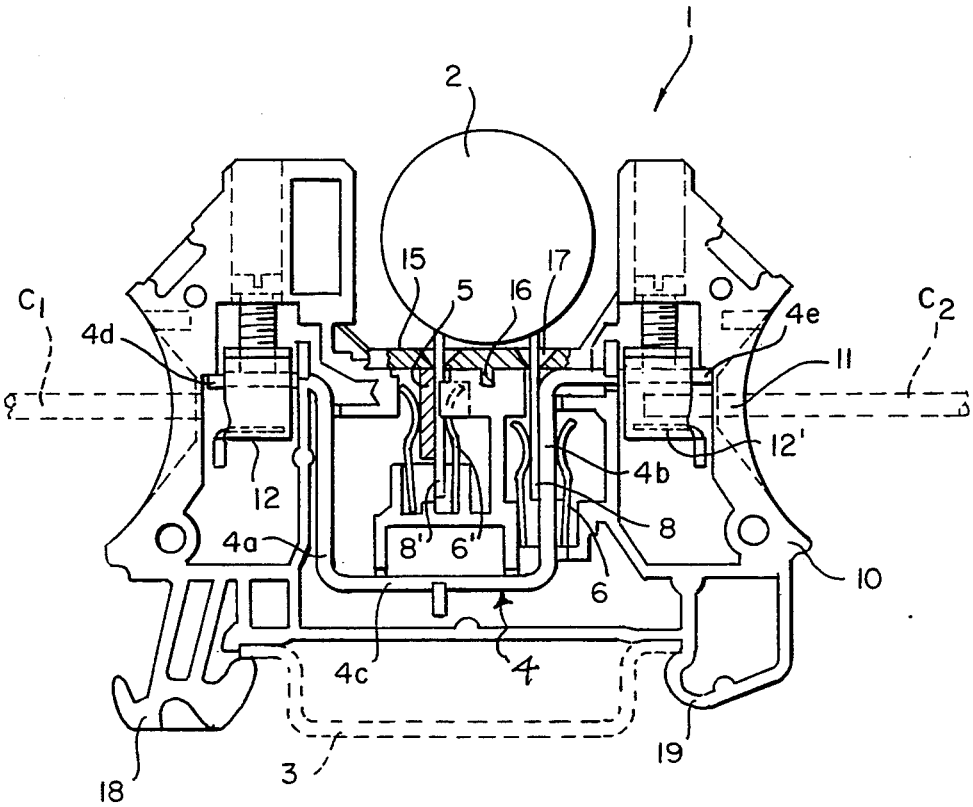
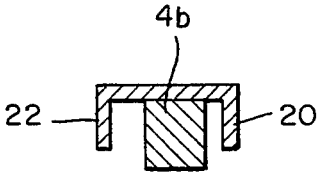
FIG. 5
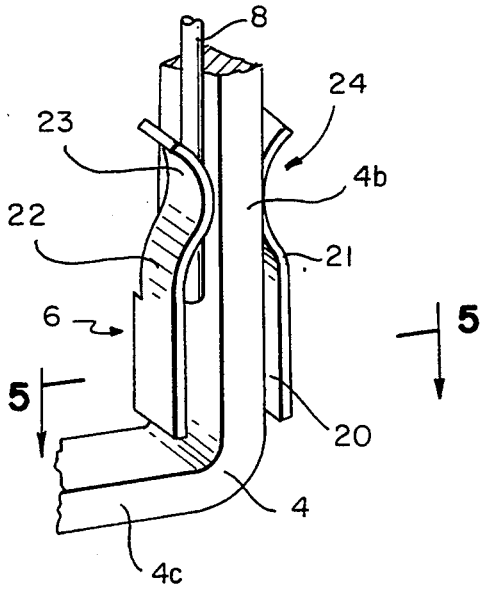
FIG. 2

TERMINAL BLOCK ARRANGEMENT WITH OVERVOLTAGE PROTECTION COMPONENT

STATEMENT OF THE INVENTION

A terminal block arrangement includes a pair of electrical terminals arranged in spaced relation on a terminal block body, a conductive terminal bus bar electrically connected between the terminals, and an overvoltage protective component removably connected with the terminal block body by a pair of resilient members which maintain the leads of the component in frictional electrical engagement with the conductive terminal bus bar and with a ground conductor, respectively.

BRIEF DESCRIPTION OF THE PRIOR ART

Terminal block arrangements have been proposed in the prior art for use in circuit breaker cabinets to protect delicate and sensitive electronic components against overvoltage surges that occur in an electrical system. Normally when such overvoltage surges occur, they are conducted to ground via an overvoltage protection member that is activated to prevent harmful influence on the electrical components connected with the terminal block. After the overvoltage surge is terminated, the housings of the overvoltage components are generally discolored, whereupon the components are replaced by fresh components. Fuji Electric Company produces a terminal block arrangement including overvoltage protection components that are connected with the conductive bus bars by electrically conductive retaining elements. These retaining elements thus combine a mechanical retaining function with an electrical transmission function, thereby resulting in the drawback that, for example, in selecting the material for the resilient retaining members, certain compromises must be reached regarding the functions to be performed. Furthermore, in the terminal blocks of the prior art, a plurality of electrical contact junctions, are normally present thereby producing an undesirable junction resistance at every contact junction.

The present invention was developed to provide an improved terminal block construction having favorable properties as a consequence of its construction, together with lower manufacturing costs.

SUMMARY OF THE INVENTION

Accordingly, a primary object of the present invention is to provide an improved terminal block arrangement including resilient members for electrically connecting an overvoltage protection device between the terminal bus bar and ground, use being made of resilient connecting members for removably connecting the leads of the overvoltage protective device with the junction bus bar and with the ground conductor, respectively. By directly connecting the leads of the overvoltage protecting device in surface-to-surface engagement with the terminal bus bar and with ground, at least two current junction points (and the attendant two junction resistances) are eliminated.

According to another object of the invention, the resilient connecting elements for maintaining the leads of the overvoltage protective device in surface-to-surface engagement with the corresponding electrical conductors, respectively, may be formed of a non-conductive material, or a material having a purely mechanical function for supplying the contact force necessary to produce good current transmission between the leads of the overvoltage protective device and the terminal bus bar and the ground conductor, respectively. Thus, the resilient elements may be formed from a material affording optimum resilient properties for the elements used. Since the resilient members do not conduct current, they are not subjected to the aging phenomena normally produced in conductive resilient components. This consideration is especially important where the time intervals between the replacement of the overvoltage protective devices are relatively long.

According to a further object of the invention, the terminal block arrangement is relatively inexpensive to produce and assemble since only two resilient elements are required, and since these elements may be simply mounted within the terminal block housing without any additional connection to the terminal block body. This offers the further advantage that, by retrofitting terminal blocks with a pair of resilient elements, one conductive terminal bus bar and one overvoltage protection member, the operation of a terminal block module may be modified or expanded in a very simple manner. The resilient elements can be inserted in a flexible manner basically from any given direction.

According to a further object of the invention, the ground conductor might comprise the supporting rail upon which the terminal block housings are mounted within a switch cabinet. Thus, one resilient element might be used to connect the lead from the overvoltage protective member to a portion of the grounded supporting rail, either directly or through an intermediate conducting member. The resilient elements are of a relatively simple construction, and normally include a unitary body portion having a U-shaped cross-sectional configuration, and a pair of parallel spaced resilient arm portions between which the leads of the overvoltage production device and the associated conductors are maintained in engagement. Preferably these resilient arm portions of the resilient member are each of a convex configuration including portions that are biased toward each other, thereby affording a particularly simple and reasonably priced component for supplying adequate contact force.

BRIEF DESCRIPTION OF THE DRAWINGS

Other object and advantages of the invention will be come apparent from a study of the following specification, when viewed in the light of the accompanying drawings in which:

FIG. 1 is a longitudinal sectional view of a first embodiment of the invention;

FIG. 2 is a detailed perspective view of one of the resilient members of FIG. 1;

FIG. 5 is a sectional view taken along line 5—5 of FIG. 2.

DETAILED DESCRIPTION

Figure 3:
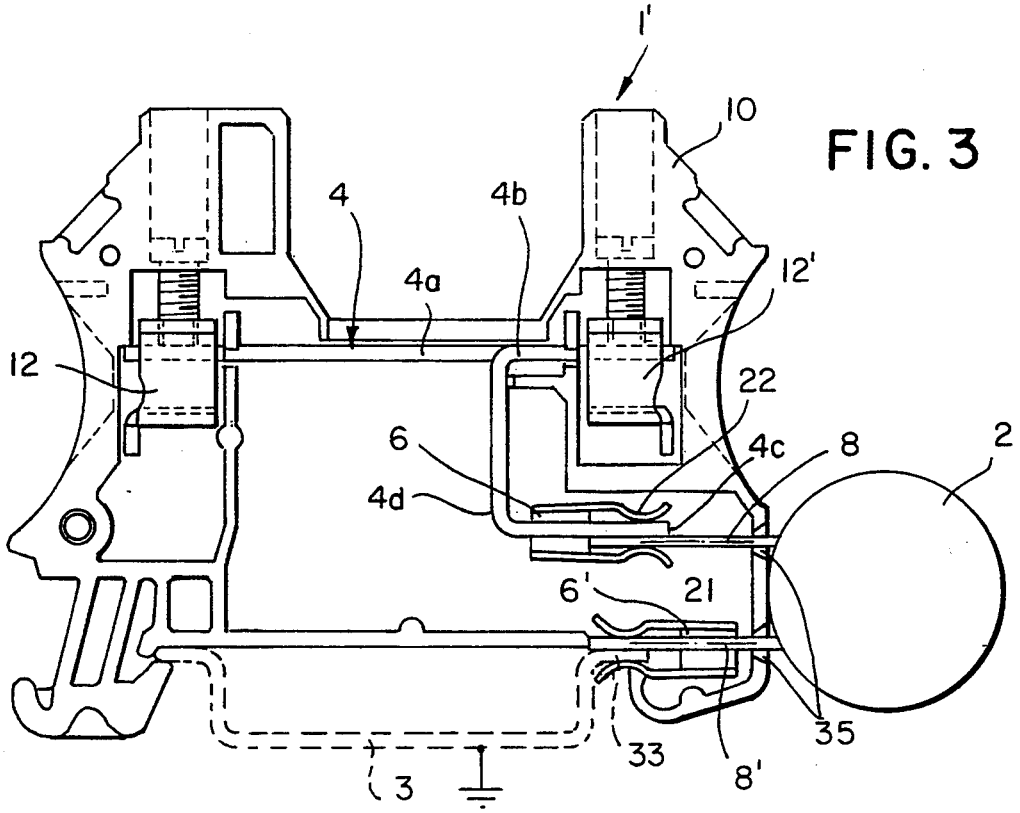
FIGS. 3 and 4 are sectional views of two other embodiments of the invention, respectively.

Referring first more particularly to FIGS. 1 and 2, the terminal block arrangement includes a body member 1 formed of a suitable non-conductive synthetic plastic material and within which are mounted a pair of screw terminals 12 and 12'for receiving the ends of conductors $C_1$ and $C_2$, respectively, inserted via body openings 11. The terminals 12 and 12' are electrically connected together by the bare terminal conductive bus bar 4 having a U-shaped configuration including a parallel spaced leg portions 4a and 4b joined at their lower ends by a connecting portion 4c, said leg portions having at their upper ends outwardly extending wing portions 4d and 4e that are in electrically conductive contact with the ends of the conductors $C_1$ and $C_2$, respectively. The terminal block body contains a chamber that is closed by the removable cap member 15 and within which is removably mounted a ground bar 5 that extends normal to the plane containing the terminals 12 and 12' and the conductive terminal bus bar 4. The terminal block body 1 has a pair of support foot portions 18 and 19 by means of which the terminal block body is mounted on a conventional U-shaped supporting rail 3.

In accordance with the present invention, an overvoltage protection device 2 (such as a varisistor) is provided having a pair of rigid conductive leads 8 and 8' that are removably connected with the terminal block body. More particularly, the first lead 8 extends through an opening 17 contained in the closure cap 15 into surface-to-surface electrical engagement with the leg portion 4b of the conductive terminal bus bar 4. The other lead 8' from the overvoltage protective device 2 extends in surface-to-surface electrical engagement with the ground bar 5. The two leads are maintained into electrical and frictional engagement with the corresponding portions of the bars 4 and 5 by resilient members 6 and 6', respectively. As shown in greater detail in FIGS. 2 and 5, the resilient support member 6 has a U-shaped lower body portion 20, and a pair of upwardly-extending parallel spaced arm portions 21 and 22 provided with convex portions 23 or 24 that maintain the first lead 8 from the overvoltage protective device 2 in electrical surface-to-surface contact with the associated leg portion 4c of the conductive rail member 4. It is important to note that the uppermost free end of the resilient arm portion 22 is arched outwardly away from the terminal conductive bus bar 4, thereby affording ease of replacement of the overvoltage protective devices 2 with their associated conductive leads 8. While the resilient support member 6 may be formed of a suitable spring metal, they may also be formed from a suitable synthetic plastic material having the appropriate resilient characteristics for biasing the lead 8 into surface-to-surface engagement with the corresponding component. The resilient support members 6 and 6' are of identical construction.

Referring now to FIG. 3, a second terminal block arrangement is disclosed in which the overvoltage protection member 2 is arranged laterally of the terminal block with its leads 8 and 8' extending in horizontal parallel vertically-spaced relation. In this embodiment, the terminal connecting bus bar 4 includes a first portion 4a extending between the terminals 12 and 12', and a second reversely bent back U-shaped portion including a first leg portion 4b parallel with the bus bar linear portion 4a, a second leg portion 4c extending horizontally in parallel spaced relation beneath the first leg portion 4b, and a vertical connecting portion 4d. In this embodiment, the first resilient member 6 biases the first lead 8 from the overvoltage protection member 2 into frictional surface-to-surface electrical contact with the horizontal portion 4c of the conductive bus bar member 4, and the second resilient member 6' serves to bias the second lead 8' into frictional surface-to-surface contact with the horizontal edge portion 33 of the grounded U-shaped support rail 3. Thus, in this embodiment, the leads 8 and 8' of the removably connected overvoltage protection member extend through the openings 35 contained in the terminal block body 1' and are connected between the terminal conductor bar and the grounded support rail 3 by the bus bar portions 4b, 4d, and 4c. Consequently in this embodiment, the provision of a separate ground bus bar corresponding with the bus bar 5 of FIG. 1 is eliminated.

Figure 4:
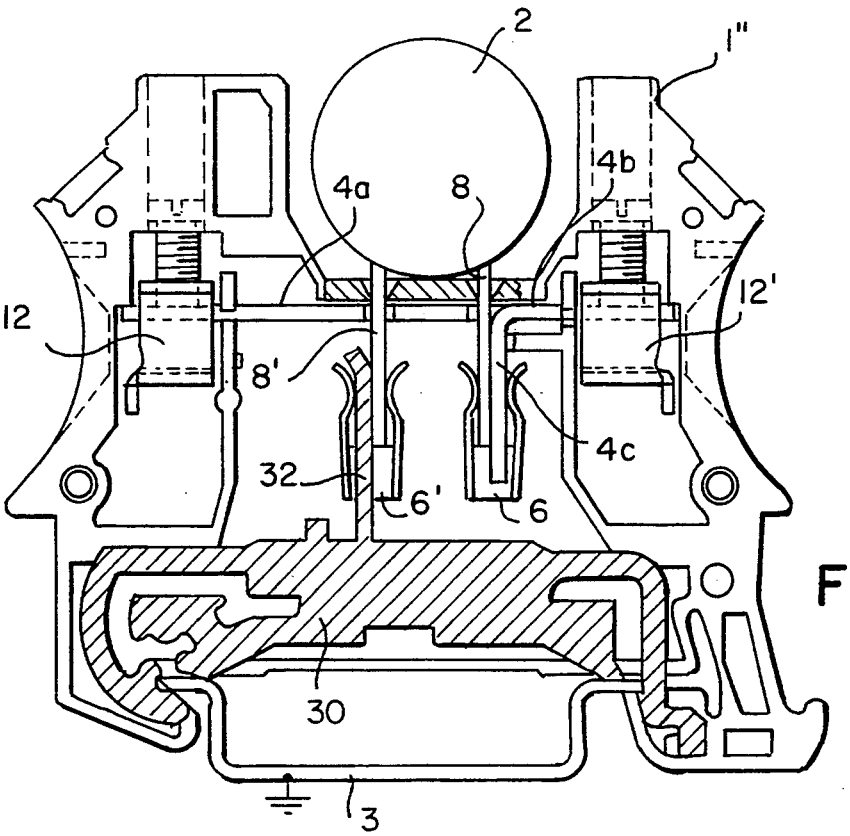

Referring now to the embodiment of FIG. 4, the overvoltage protection device 2 includes a first conductive lead 8 that extends downwardly into surface-to-surface frictional and electrical engagement with the downwardly extending portion 4b of the terminal connecting bus bar 4, and a second lead 8' which is in frictional surface-to-surface contact with the upwardly extending portion 32 of a contact member 30, which contact member has a lower portion in electrical engagement with the grounded support rail 3. The resilient members 6 and 6' maintain the leads 8 and 8' in electrical contact with the bus bar portion 4b and the contact portion 32, thereby permitting removal and replacement of the voltage overprotection device 2. For the sake of simplicity, the means for supporting the resilient members 6 and 6' in the terminal block bodies 1' and 1'' of FIGS. 3 and 4, respectively, have not been shown.

In accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A terminal block arrangement, comprising:

(a) a terminal block body (1, 1', 1'') formed from a non-conducting insulating material;

(b) a pair of electrical terminals (12, 12') mounted in spaced relation on said terminal block body;

(c) a conductive terminal bus bar (4) mounted in said terminal block body for electrically connecting together said electrical terminals, said terminal bus bar having at least one bare portion;

(d) an electrical overvoltage protective component (2) having a pair of parallel linear conductive leads (8, 8'); and (e) connecting means removably connecting said overvoltage component with said terminal block body, said connecting means including a first resilient member (6) biasing a first one (8) of said component leads into lateral frictional and electrical engagement with said bare portion of said terminal bus bar.

2. Apparatus as defined in claim 1, and further including:

(f) ground means (5,3) having at least one ground bare uninsulated portion, said connecting means including a second resilient member (6') biasing a second one (8') of said component leads into frictional and electrical contact with said ground bare portion.

3. Apparatus as defined in claim 2, wherein said ground means includes a ground bar (5) extending between, and generally normal to a plane containing, said component leads.

4. Apparatus as defined in claim 3, wherein said terminal bus bar has a generally U-shaped configuration including a pair of parallel leg portions (4a, 4b) joined at one end by a transverse portion (4c), and a pair of outwardly extending wing portions (4d,4e) at the other ends of said leg portions, respectively, said leg portions extending between said terminals with said wing portions being electrically connected with said terminals, respectively, said first component lead (8) extending between, parallel with and engagement with one of said terminal bus bar leg portions.

5. Apparatus as defined in claim 4, and further wherein said ground bar extends in spaced relation between said terminal bus bar leg portions, said ground bar having a contact surface parallel with said terminal bus bar leg portions, said second resilient member maintaining said second component lead (8') in engagement with said ground bar contact surface.

6. Apparatus as defined in claim 2, wherein said terminal block body (1', 1'') is generally rectangular and includes a top side at which said terminals are mounted, and further including a support rail (3), said terminal block body having a bottom side that is mounted on said support rail.

7. Apparatus as defined in claim 6, wherein said support rail is conductive and is grounded, said support rail being U-shaped and including a pair of vertical leg portions (3*a*,3*b*), a horizontal transverse portion (3*c*) joining the lower ends of said leg portion, and a pair of horizontal outwardly extending wing portions (33) at the upper ends of said leg portions, respectively, and means electrically connecting said second component lead with said support rail.

8. Apparatus as defined in claim 7, wherein said overvoltage protective component (2) is arranged adjacent a lateral third side of said terminal block body with said conductive leads extending in horizontal vertically-spaced relation, said second conductive lead (8') being maintained by said second resilient member (6') in frictional conductive engagement with one of said support rail wing portions.

9. Apparatus as defined in claim 8, wherein said terminal bus bar includes a horizontal portion (4*c*) that extends in spaced relation above said one support rail wing portion, said first conductive lead (8) being maintained by said first resilient member (6) in frictional electrical engagement with said terminal bus bar horizontal portion.

10. Apparatus as defined in claim 7, wherein said terminal block body contains a conductive foot member (30) mounted on, and in electrical contact with, said grounded support rail, said foot member including an upwardly extending vertical portion (32), said second conductive lead (8') extending vertically downwardly and being maintained in frictional electrical contact with said foot member vertical portion by said second resilient member (6').

11. Apparatus as defined in claim 10, wherein said terminal bus bar includes a downwardly extending vertical portion (31), said first conductive lead (8) being maintained in frictional electrical engagement with said bus bar vertical portion by said first resilient member (6).

12. Apparatus as defined in claim 2, wherein each resilient member (6,6') includes a generally U-shaped body portion (20), and a pair of parallel spaced leg portions (21,22) that are resiliently biased together on opposite sides of a conductive lead and its associated electrical conductor.

13. Apparatus as defined in claim 12, wherein said resilient members are formed of a non-conductive resilient material.

* * * * *